United States Patent [19]

Menth et al.

[11] 4,192,696

[45] Mar. 11, 1980

[54] PERMANENT-MAGNET ALLOY

[75] Inventors: Anton Menth, Nussbaumen; Hartmut Nagel, Wettingen; Ulrich Spinner, Aeugst, all of Switzerland

[73] Assignee: BBC Brown Boveri & Company Limited, Baden, Switzerland

[21] Appl. No.: 906,421

[22] Filed: May 16, 1978

Related U.S. Application Data

[63] Continuation-in-part of Ser. No. 746,226, Nov. 3, 1976, Pat. No. 4,131,495.

[30] Foreign Application Priority Data

Dec. 2, 1975 [CH] Switzerland ..... 15631/75

[51] Int. Cl.[2] ..... H01F 1/04; H01F 1/14; H01F 7/02

[52] U.S. Cl. ..... 148/101; 75/152; 75/170; 148/122; 148/31.57

[58] Field of Search ..... 148/31.57, 101, 102, 148/103, 121, 122; 75/0.5 BA, 152, 170

[56] References Cited

U.S. PATENT DOCUMENTS

| | | | |
|---|---|---|---|
| 3,932,204 | 1/1976 | Masumoto et al. | 148/31.57 |
| 3,982,971 | 9/1976 | Yamanolia et al. | 148/101 |
| 4,047,982 | 9/1977 | Sagawa | 148/101 |
| 4,081,297 | 3/1978 | Nagel et al. | 148/31.57 |
| 4,099,995 | 7/1978 | Menth et al. | 148/31.57 |

FOREIGN PATENT DOCUMENTS

| | | | |
|---|---|---|---|
| 5037615 | 6/1973 | Japan | 148/103 |
| 982658 | 2/1965 | United Kingdom | 148/101 |
| 1378195 | 5/1972 | United Kingdom | 148/103 |
| 515826 | 5/1976 | U.S.S.R. | 148/31.57 |

*Primary Examiner*—L. Dewayne Rutledge
*Assistant Examiner*—Michael L. Lewis
*Attorney, Agent, or Firm*—Oblon, Fisher, Spivak, McClelland & Maier

[57] ABSTRACT

Permanent-magnet alloys having the general formula $$RE(Co_{1-u-v-w-x-y}Fe_uMn_vCr_wV_xX_y)_z$$

wherein RE is samarium, cerium, cerium mischmetal (MM), praseodymium, neodymium, lanthanum or mixtures thereof, X is Al, Cu or mixture thereof, and

| | |
|---|---|
| $0.05 < u < 0.15$ | $0.084 \leqq u < 0.15$ |
| $0.003 \leqq v < 0.15$ | $0.02 < v < 0.15$ |
| $0.003 \leqq w < 0.10$ | $0 = w$ |
| $0.003 \leqq x < 0.10$ | $0 = x$ |
| $0.05 < y < 0.20$ | $0.05 < y < 0.20$ |
| $6.5 < z < 8.5$ | $6.5 < z < 8.5$ |
| $0.084 \leqq u < 0.15$ | $0.05 < u < 0.15$ |
| $0 = v$ | $0.02 < v < 0.15$ |
| $0.02 < x < 0.10$ | $0.02 < w < 0.10$ |
| $0 = w$ | $0.02 < x < 0.10$ |
| $0.05 < y < 0.20$ | $0.05 < y < 0.20$ |
| $6.5 < z < 8.5$ | $6.5 < z < 8.5$ |

5 Claims, 4 Drawing Figures

PERMANENT-MAGNET ALLOY

This application is a continuation-in-part application of Ser. No. 746,226, filed Nov. 3, 1976 and now U.S. Pat. No. 4,131,495.

BACKGROUND OF THE INVENTION

1. Field of the Invention

The present invention is concerned with a permanent magnet alloy comprising cobalt and at least one of the rare earth (RE) metals together with copper and/or aluminum. This invention is further concerned with a method of producing the permanent-magnet alloy and with uses thereof.

2. Description of the Prior Art

Hard-magnetic materials comprising inter-metallic compounds of cobalt with rear earths are known in numerous forms. The most developed, $SmCo_5$ (1/5), magnets exhibit inner coercive field strengths, $_IH_C$, of 20KOe and more, along with remanence values, Br, of 9 KG. Such hard magnets, produced both from the melt and by powder metallurgy, have been described in numerous publications (e.g., D. L. Martin and M. G. Benz, *Permanent-Magnet Alloys of Cobalt with Rare Earths,* Kobalt 50, 10, 1971). On the other hand, the $Sm_2CO_{17}$ (2/17) alloys have had little commercial use for making permanent magnets. This is mainly due to their partially poorer primary-magnetic properties as compared to those of the 1/5 types, particularly, with respect to the anisotropy field, $H_4$, and due to the technological difficulties in making acceptably hard magnets using such alloys. Therefor, it has long been attempted to improve the primary properties, anisotropy field, $H_A$, and saturation magnetization, $M_s$, of (2/17) alloys by adding other elements to the alloy. Moreover, attempts have been made to optimize these values in finished hard magnets by incorporating suitable production steps. The effect of such additives on the properties is known from various publications (e.g., Nesbitt et al, Appl. Phys. Letters, vol. 12, pp. 361–362, June 1968; Ray et al, USAF Materials Laboratory, Wright-Patterson Air Force Base, Ohio, AFML-TR-71-53, 1971; 71-210, 1971; 72-99, 1972; 72-202, 1972; 73-112, 1973; Senno et al, in DT-OS No. 2,406,782 IEEE Transactions on Magnetics, vol. MAG 10, No. 2, June 1974).

From the production technology side, in connection with the powder-metallurgic manufacture of $SmCo_5$ hard magnets, there is known first of all the so-called "sintering with liquid phase" method (Benz et al, Appl. Phys. Letters 17,176,1970). It is known further that magnetic hardening of the alloy by addition of copper is largely independent of the parameters which govern the usual methods of choosing particle size. In particular, the troublesome and expensive fine grinding process can be avoided (e.g., Proceedings of the 3rd European Conference on Hard Magnetic Materials, Amsterdam 1974, p. 149).

Significantly detracting from the exceptionally hard-magnetic properties of the $SmCo_5$ alloys is their high price. On the other hand, for special applications such as loudspeakers and electrical machines, there is a strong need for higher remanence permanent magnets. There are indeed hand-magnetic alloys with remanence values above 12 KG, but their coercive field strengths are under 1 KOe. This limits their applicability to devices with only very weak demagnetizing counter fields. In contrast, the 2/17 materials exhibit a more favorable demagnetization curve, and thus can be better used for the above mentioned purposes. Up to now, the 2/17 alloys have scarcely been used for the production of permanent magnets, since the magnetic properties achieved with them were unsatisfactory.

From the point of view of the process of preparing the alloys, the desire is for the most far-reaching simplification, economization and shortening possible. In order to obtain acceptable sintered pieces by powder metallurgy, more or less high proportions of samarium-rich sinter additives must be mixed into the starting material in practically all known methods, whereby the end product is made expensive both material and process-wise.

SUMMARY OF THE INVENTION

Accordingly, it is one object of the present invention to develop 2/17 alloys from which acceptable permanent magnets with the highest possible remanence (>9 KG) and simultaneously sufficient coercive field strengths (>3 KOe) can be made.

It is another object of this invention to simplify the production process, in particular by eliminating the need for the use of the fine-grinding process and special samarium-rich sinter additive.

It is still another object of this invention to make possible a lower cost end-product by avoiding the use of expensive starting materials.

Briefly, these and other objects of this invention as will hereinafter become clear have been attained by providing permanent-magnet alloys of the aforementioned type having the general formula $$RE(Co_{1-u-v-w-x-y}Fe_uMn_vCr_wV_xX_y)_z$$

wherein RE is samarium, cerium, cerium mischmetal (MM), praseodymium, neodymium, lanthanum or mixtures thereof, X is Cu, Al or mixtrues thereof, and

| | |
|---|---|
| $0.05 < u < 0.15$ | $0.084 \leqq u < 0.15$ |
| $0.003 \leqq v < 0.15$ | $0.02 < v < 0.15$ |
| $0.003 \leqq w < 0.10$ | $0 = w$ |
| $0.003 \leqq x < 0.10$ | $0 = x$ |
| $0.05 < y < 0.20$ | $0.05 < y < 0.20$ |
| $6.5 < z < 8.5$ | $6.5 < z < 8.5$ |
| $0.084 \leqq u < 0.15$ | $0.05 < u < 0.15$ |
| $0 = v$ | $0.02 < v < 0.15$ |
| $0.02 < x < 0.10$ | $0.02 < w < 0.10$ |
| $0 = w$ | $0.02 < x < 0.10$ |
| $0.05 < y < 0.20$ | $0.05 < y < 0.20$ |
| $6.5 < z < 8.5$ | $6.5 < z < 8.5$ |

These permanent-magnet alloys are made in a particularly advantageous way by first subjecting the alloy of the melted and cast starting materials to a homogenizing heat treatment just above its solidus temperature or in the temperature region of maximum solubility of the non-RE and —Co components in the $RE_2Co_{17}$ mixed crystal; then crushing the alloy; grinding it to a particle size beween 2 μm and 10 μm; magnetically aligning the resultant powder; isostatically compressing it; sintering the resultant briquette just below its solidus temperature; and finally annealing it in the temperature range between 700° C. and 900° C.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 2:
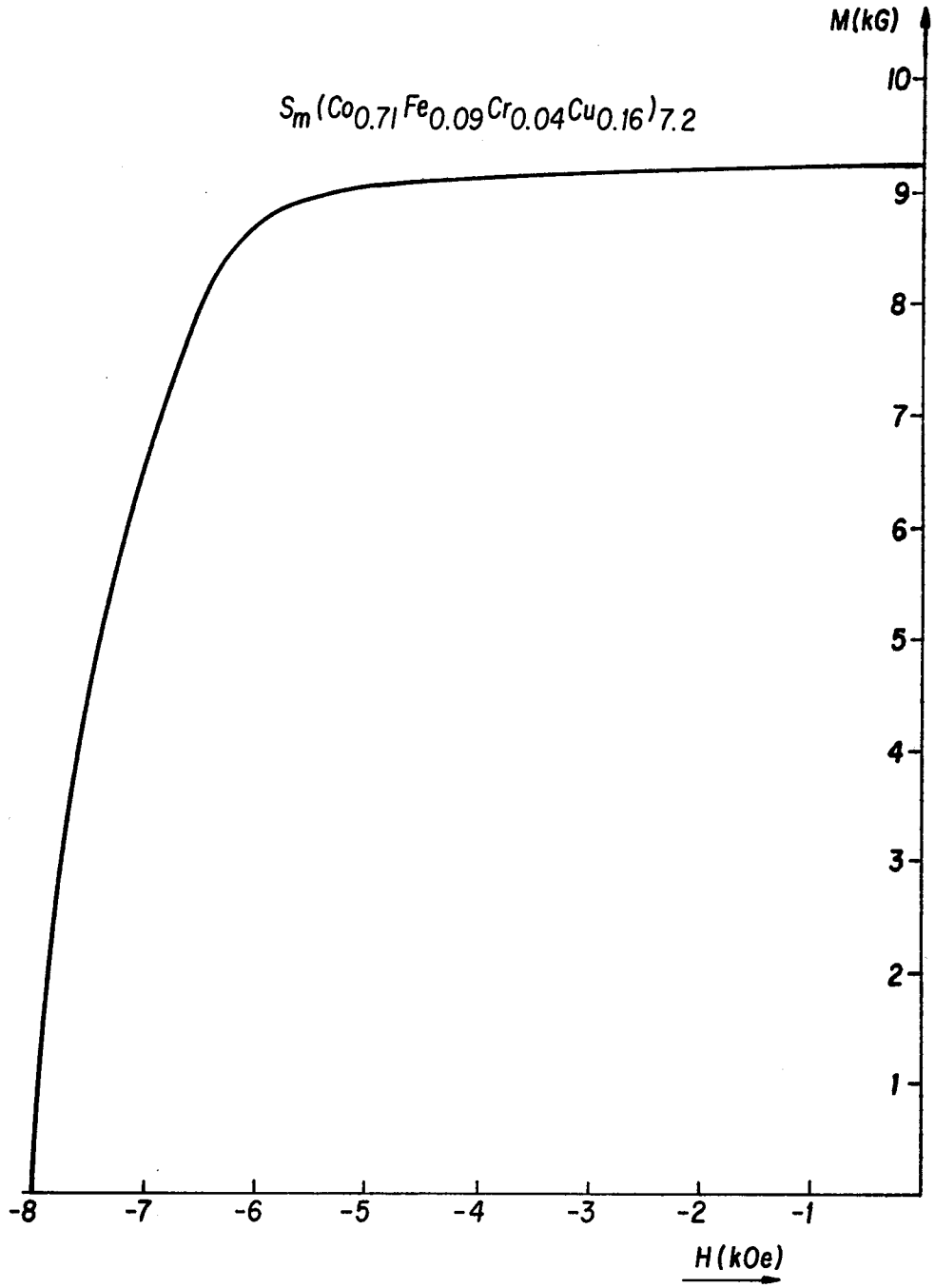
Figure 3:
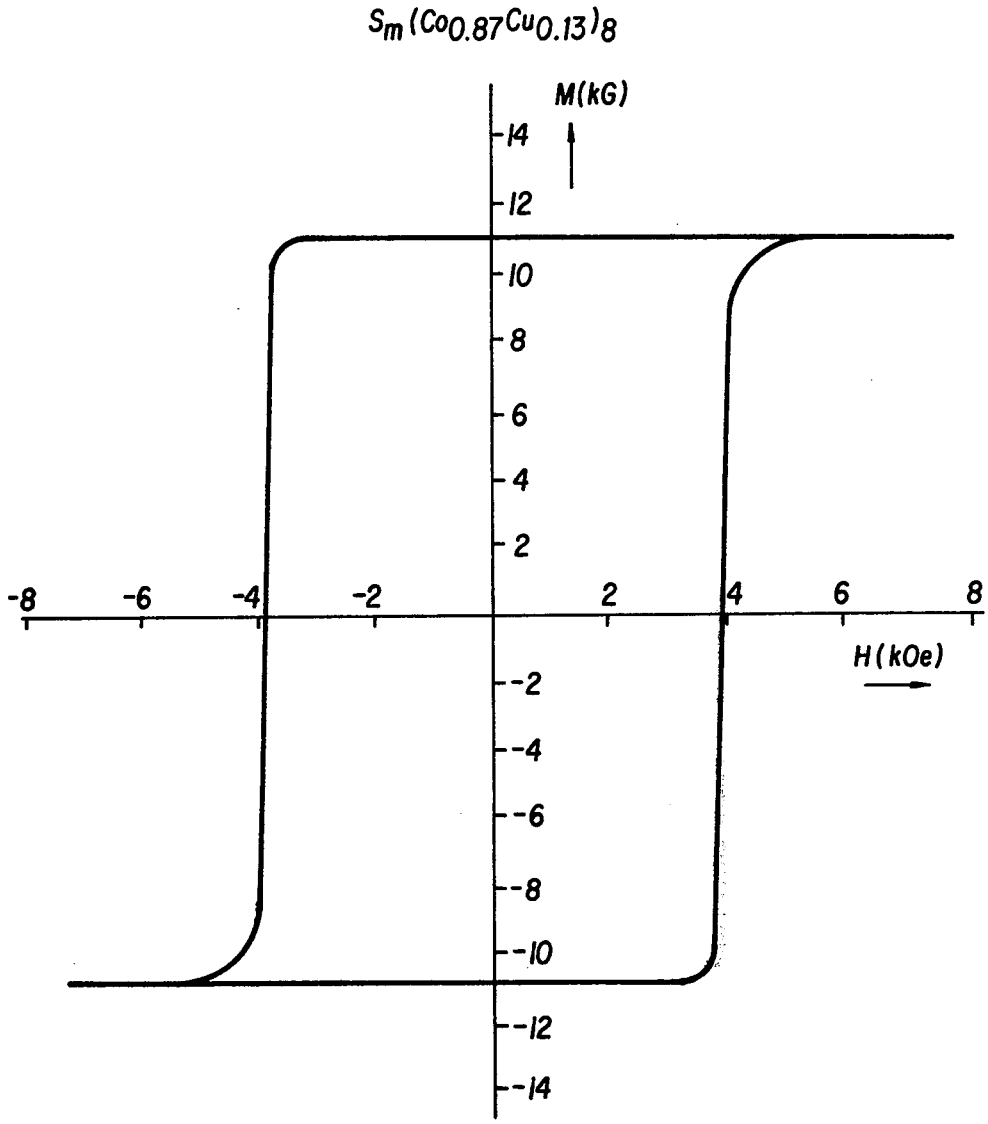

as in Example 1;

FIG. 2 shows the demagnetization curve magnetization M(KG) vs. field strength H(KOe) for a sintered permanent magnet of the composition $$Sm(Co_{0.71}Fe_{0.09}Cr_{0.04}Cu_{0.16})_{7.2}$$

as in Example 2;

FIG. 3 shows the complete magnetization and demagnetization curve magnetization M(KG) vs. field strength H(KOe) for solid, compact magnet material of composition $$Sm(Co_{0.87}Cu_{0.13})_8$$

as in Example 4; and

Figure 4:
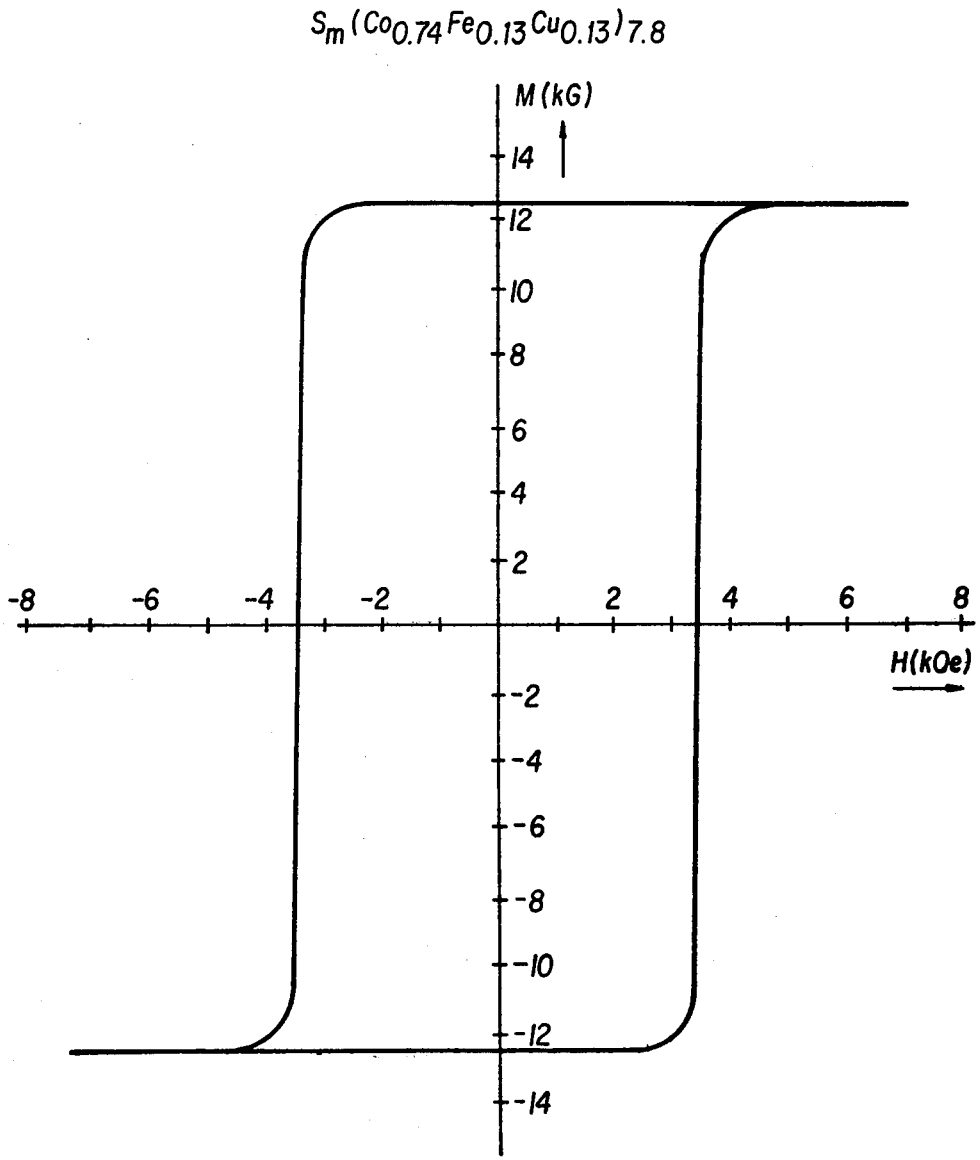

FIG. 4 is the complete magnetization and demagnetization curve magnetization M(KG) vs. field strength H(KOe) for solid, compact magnet material of composition $$Sm(Co_{0.74}Fe_{0.13}Cu_{0.13})_{7.8}$$

as in Example 5.

DETAILED DESCRIPTION OF THE PREFERRED EMBODIMENTS

The basic alloy of this invention is essentially a mixed crysta of the structural type, $RE_2Co_{17}$(2/17). According to the content of alloy elements (parameters u,v,w,x,y) and the determining index z, two groups can be distinguished. If z is 8.5, or is just less than this value, the alloy belongs exclusively to the 2/17 type. Only a single homogeneous phase can be detected metallographically. If, however, z lies between 6.5 and about 7.2, there are in addition to the 2/17 matrix, limited amounts of other phases, mainly 1/5, 2/7 and 1/3 types, depending on the temperature range and cooling conditions employed during preparation. The alloys of this invention are distinguished by the fact that the amount of the different components are optionally adjusted with respect to one another so as to attain the best magnetic properties.

Particularly preferred alloys are those satisfying the following requirements:

(a)

$RE=Sm_rCeMM_s$, $0.5<r<1.0$ $0<s<0.5$, and $r+s=1$ (b)

$0.05<u\ 0.13$, $0.02<v<0.05$ $0.02<w<0.05$, $0.02<x<0.05$, $0.10<y<0.18$, and $7.0<z<7.5$ (c)

$0.05<u<0.3$, $0.02<v<0.05$, $0.02<w<0.05$, $0.02<x<0.05$, $0.10<y<0.18$, and $7.5<z<8.5$ (d)

$0<u<0.15$, $y=0.13$, and $z=7.8$ (e)

$0.04<u<0.10$, $y=0.16$, and $z=7.2$ (f)

$0.04<u<0.10$, $w=0.02$, $y=0.16$, and $z=7.2$ (g)

$0.04<u<0.10$ $y=0.13$, and $7.8<z<8.5$ (h)

$0.05\leqq u<0.15$ $0.003\leqq v<0.15$ $0.003\leqq w<0.10$ $0.003\leqq x<0.10$ $0.05<y<0.2$ $6.5<z<8.5$ (i)

$0.084 \leqq u < 0.15$ $0.02 < v < 0.15$ $0 = w$ $0 = x$ $0.05 < y < 0.20$ $6.5 < z < 8.5$ (j)

$0.084 \leqq u < 0.15$ $0 = v$ $0 = w$ $0.02 < x < 0.10$ $0.05 < y < 0.20$ $6.5 < z < 8.5$ (k)

$0.05 < u < 0.15$ $0.02 < v < 0.15$ $0.02 < w < 0.10$ $0.02 < x < 0.10$ $0.05 < y < 0.20$ $6.5 < z < 8.5$

A basic feature of the production method of this invention is that by selection of the alloy composition as above and by carrying out the process as above, at the start of sintering, in the region of the peritectic transition, a small proportion of samarium-rich melt will be present, partially or completely enveloping the individual powder grains. At the end of sintering this Sm-rich portion will be largely or entirely dissolved into the 2/17 phase. These conditions are satisfactorily fulfilled with the parameter z in the vicinity of 7.2, although the nature of the alloy composition as a whole is relevant. Thus, the range of z is generally 6.5–8.5.

This enveloping of the grains by the melt can be achieved by a homogenization step at a suitable temperature as described herein. Homogenization and sintering temperatures will depend on the composition of the alloy, mainly the z-value. These temperatures are always in the neighborhood of the solidus line. The principle is always the same: Creation of a "temporary liquid phase" and/or "draft" towards the maximum solubility range of the 2/17-type mixed crystal. The multicomponent phase diagrams governing this range can be deduced by those skilled in the art from the corresponding published binary and ternary systems.

The preferred temperature range for the aforementioned homogenization heat treatment is around 1300° C. for a pure Sm/Co-alloy, but generally is considerably lowered by addition of further components. Thus, the practical homogenization temperature for this invention is approximately 1200° C.

The steps of the method of this invention may be carried out in a manner which is completely conventional for processing of alloys which are similar in composition. The conditions for each step are not critical except for those features specifically described herein. In other words, the present invention involves the sequence of the steps and the specifically defined conditions described above as they affect the production of alloys having the composition of this invention.

Having generally described this invention, a further understanding can be obtained by reference to certain specific examples which are provided herein for purposes of illustration only and are not intended to be limiting unless otherwise specified.

EXAMPLE 1

The following weights of alloy components were melted in a boron nitride crucible in an induction oven ($10KH_z$) under an argon atmosphere to form a permanent magnet material:

| | |
|---|---|
| Samarium: | 32.51 g |
| Cobalt: | 62.77 g |
| Copper: | 15.51 g |
| Iron: | 6.98 g |
| Manganese: | 3.45 g |
| Total | 121.22 g |

These weights correspond to the formula $$Sm(Co_{0.711}Cu_{0.163}Fe_{0.084}Mn_{0.042})_{7.2}$$

A 41% excess of samarium is used to compensate for the loss of samarium occurring during the melting process and the subsequent homogenization annealing, chiefly by evaporation. The solidified melt was homogenized at 1200° C. for 1 hour and then wet-chemically analyzed, the result confirming, within the accuracy of the measurement, the formula given above. The homogenized material was crushed to a particle size of 0.5 mm and ground to a powder having an average particle diameter of 4 μm (measured with a Fisher sub-sieve sizer) in an opposed-jet mill with nitrogen as the working gas. The finished powder was packed under a protective atmosphere into a cylindrical silicon mold of 7.5 mm diameter and 45 mm length. It was then magnetically aligned in a pulsed magnetic field of 38 KOe and compressed under 6000 atm to a briquette of 70% theoretical density ($\rho th = 8.50$ g/cm$^3$). The briquette was sintered under argon at 1160° C. for a half hour, bringing the density up to 99% (8.44 g/cm$^3$). The dimensions of the sintered permanent magnet were about 6 to 6.5 mm diameter and 30 to 35 mm length. The sintered piece was annealed at 800° C. in an argon atmosphere for a half hour. The magnetic measurement of the specimen was carried out with a fluxmeter in the field of a superconducting coil of up to 50KOe field strength. The properties of the finished, sintered permanent magnet were as follows:

$B_r = 9.5$ KG ${}_IH_C = 7.0$ $KO_e$ $H_K = 6.1$ $KO_e$

Metallographic structure: essentially, optically a monophase 2/17, but with oxide residues in the grain boundries.

Figure 1:
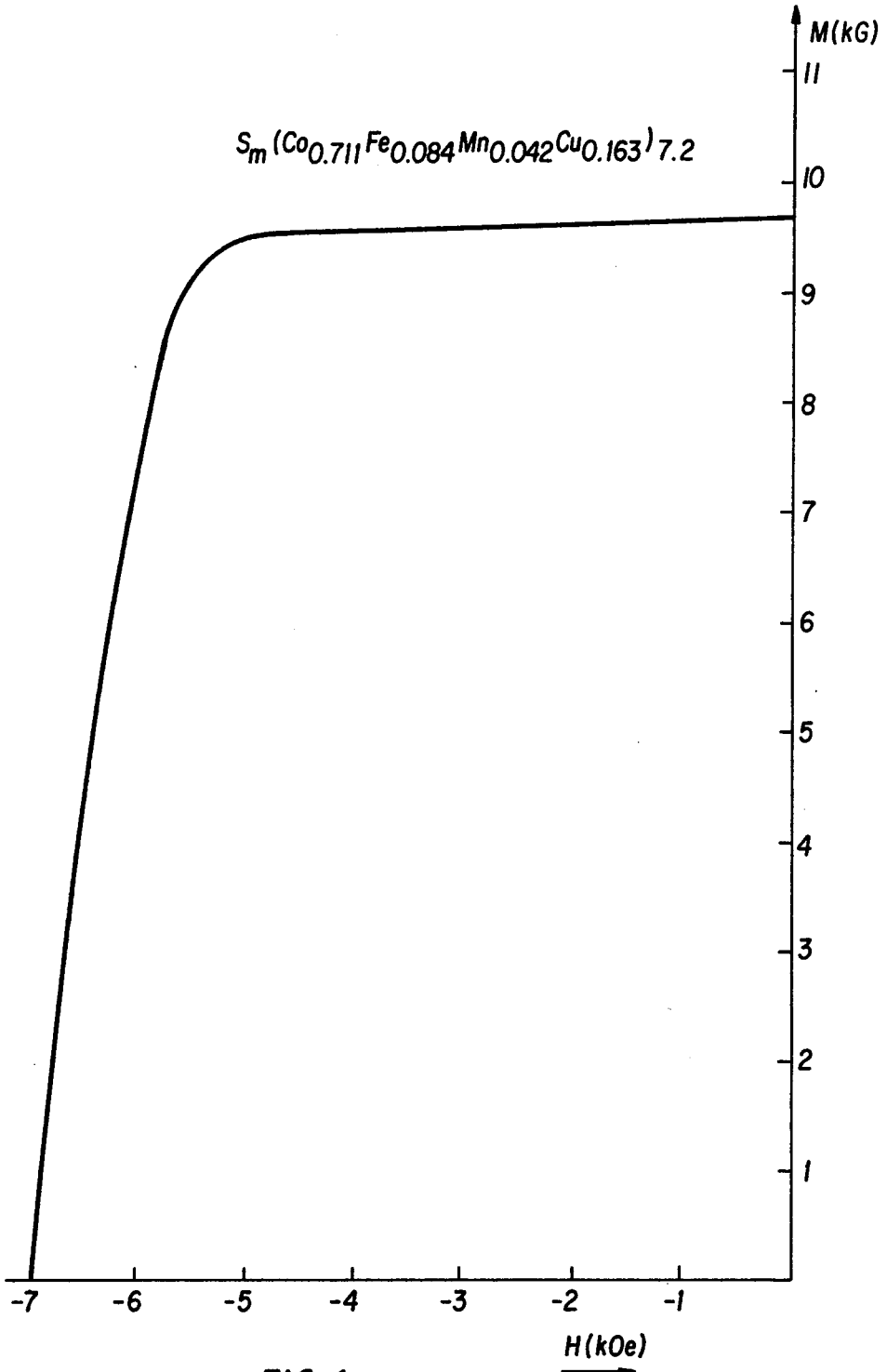
FIG. 1 shows the demagnetization curve magnetization M(KG) vs. field strength H(KOe) for a sintered permanent magnet of the composition $$Sm(Co_{0.711}Fe_{0.084}Mn_{0.042}Cu_{0.163})_{7.2}$$

The demagnetization curve of the permanent magnet of Example 1 is shown in FIG. 1.

The following examples are sintered permanent magnets produced in an analogous manner to Example 1.

EXAMPLE 2

Material: $Sm(Co_{0.71}Fe_{0.09}Cr_{0.04}Cu_{0.16})_{7.2}$
Homogenization: 1180°/1 hour
Grinding to particle size of: 4 μm
Sintering: 1150° C./½ hour
Annealing: 800° C./1 hour
Properties of the sintered specimen:
Density=8.45 g/cm³
$B_r$=9.2 KG
$_iH_C$=8.0 KOe
$H_K$=6.3 KOe
Metallographic structure: essentially, optically, a monophase 2/17, but with oxide residues in the grain boundries.

The demagnetization curve of the permanent magnet of Example 2 is shown in FIG. 2.

EXAMPLE 3

Material: $Sm(Co_{0.73}Fe_{0.09}V_{0.02}Cu_{0.16})_{7.2}$
Homogenization: 1200° C./1 hour
Grinding to particle size of: 4 μm
Sintering: 1155° C./½ hour
Annealing: 800° C./1 hour
Properties of the sintered specimen:
Density=8.42 g/cm³
$B_r$=9.7 KG
$_iH_c$=5.5 KOe
$H_k$=4.0 KOe
Metallographic structure: essentially, optically a monophase 2/17, but with oxide residues in the grain boundries.

Further examples are given below of permanent magnet alloys which were melted, cast, homogenized and annealed as described for Example 1.

EXAMPLE 4

Material: $Sm(Co_{0.87}Cu_{0.13})_8$
Homogenization: 1200° C./6 days
Annealing: 800° C./1 hour
Properties of the solid, compact material:
Ms=10.9 KG
$_iH_c$=3.9 KOe
$H_k$=3.9 KOe
Metallographic structure: optically a monophase 2/17.

The complete magnetization and demagnetization curve of the permanent magnet-primary alloy of Example 4 is given in FIG. 3.

EXAMPLE 5

Material: $Sm(Co_{0.74}Fe_{0.13}Cu_{0.13})_{7.8}$
Homogenization: 1180° C./40 hours
Annealing: 800° C./1 hour
Properties of the solid, compact material:
Ms=12.2 KG
$_iH_c$=3.5 KOe
$H_k$=3.2 KOe
Metallographic structure: optically, a monophase 2/17.

The complete magnetization and demagnetization curve of the permanent magnet-primary alloy of Example 5 is shown in FIG. 4.

EXAMPLE 6

Material: $Sm(Co_{0.777}Fe_{0.084}Mn_{0.003}Cr_{0.003}V_{0.003}Cu_{0.130})_{7.5}$
Homogenization: 1200° C./6 days
Annealing (Temperature): 800° C./4 hours
Properties of the solid, compact material:
$M_S$=11.1 kG
$_iH_C$=6.1 kOe

EXAMPLE 7

Material: $Sm(Co_{0.777}Fe_{0.084}Cu_{0.080}Al_{0.050}Mn_{0.003}Cr_{0.003}V_{0.003})_{7.5}$
Homogenization: 1200° C./6 days
Annealing (Temperature): 800° C./4 hours
Properties of the solid, compact material:
$M_S$=10.5 kG
$_iH_C$=4.0 kOe
Metallographic structure: optically, a monophase 2/17.

The new permanent-magnet alloys of this invention, enable the fabrication of preferably sintered permanent magnets having high remanence with satisfactorily large coercive field strength. By proper choice of the alloy components, the magnetic properties can largely be tailored to the application. The alloys of this invention can also be for the production of magnets with directed crystallization and can be used as the active substance for solid solutions with a ceramic or plastic binder.

By using the production methods of this invention, the costly fine-grinding process can be by-passed and the need for special sinter additives avoided. This results in a simplified technology and a lower priced end product.

The alloys of this invention are especially advantageous when used in making permanent magnets for which, until now, only Al-Ni-Co-Fe alloys were considered. For such applications, high remanence is required, while in operation, however, rather high demagnetizing fields are to be expected. Thus, the present invention has closed a genuine gap and simultaneously overcome the existing widespread prejudice in the technical world that no commercially useful permanent magnets can be made from alloys of the 2/17 type.

Having now fully described this invention, it will be apparent to one of ordinary skill in the art that many changes and modifications can be made thereto without departing from the spirit or scope of the invention set forth herein.

What is claimed as new and intended to be covered by Letters Patent is:

1. A permanent magnet alloy selected from the group consisting of $$RE(Co_{1-u-v-w-x-y}Fe_uMn_vCr_wV_xX_y)_z$$

wherein RE is samarium, cerium, cerium mischmetal (MM), praseodymium, neodymium, lanthanum or mixtures thereof, X is Al, copper or a mixture thereof, and $0.05<u<0.15$
$0.003<v<0.15$
$0.003<w<0.10$
$0.003<x<0.10$
$0.05<y<0.20$
$6.5<z<8.5$ which has been prepared by the process which comprises homogenization heat-treating the alloy of the molten and cast starting materials at a temperature just above the solidus temperature or in the temperature range in which the non-RE and non-Co components of the alloy have their maximum solubility in the $RE_2Co_{17}$ mixed crystals; crushing and grinding the alloy to particles of a size of from 2 μm to 10 μm of monophase $RE_2Co_{17}$ crystals; magnetically aligning the resultant powder; isostatically compressing the resultant powder; sintering the resultant briquette just below the solidus temperature; and finally annealing the alloy at a temperature between 700° C. and 900° C.

2. A permanent magnet monophase alloy selected from the group consisting of $$RE\ (Co_{1-u-v-w-x-y}Fe_uMn_vCr_wV_xX_y)_z$$

wherein RE is samarium, cerium, cerium mischmetal (MM), praseodymium, neodymium, lanthanum or mixtures thereof, X is copper, aluminum or mixtures thereof, and $0.05<u<0.15$
$0.003\leqq v<0.15$
$0.003\leqq w<0.10$
$0.003\leqq x<0.10$
$0.05<y<0.20$
$6.5<z<8.5$ which has been prepared by the process which comprises casting the alloy of the molten starting materials in a physical shape as similar as possible to that desired for the end product; solidifying the cast alloy by directed crystallization; homogenizing it at a temperature just below the solidus temperature; and then annealing heat-treating it in the region from 700° C. to 900° C.

3. A permanent magnet alloy selected from the group consisting of $$RE(Co_{1-u-v-x-w-y}Fe_uMn_vCr_wV_xX_y)_z$$

wherein RE is samarium, cerium, cerium mischmetal (MM), praseodymium, neodymium, lanthanum or mixtures thereof, X is Cu, Al or mixtures thereof and $0.05<u<0.15$
$0.02<v<0.15$
$0.02<w<0.10$
$0.02<x<0.10$
$0.05<y<0.20$
$6.5<z<8.5$ which has been prepared by the process which comprises homogenization heat-treating the alloy of the molten and cast starting materials at a temperature just above the solidus temperature or in the temperature range in which the non-RE and non-Co components of the alloy have their maximum solubility in the $RE_2Co_{17}$ mixed crystals; crushing and grinding the alloy to particles of a size of from 2 μm to 10 μm of monophase $RE_2Co_{17}$ crystals; magnetically aligning the resultant powder; isostatically compressing the resultant powder; sintering the resultant briquette just below the solidus temperature; and finally annealing the alloy at a temperature between 700° C. and 900° C.

4. A permanent magnet monophase alloy selected from the group consisting of $$RE(Co_{1-u-v-w-x-y}Fe_uMn_vCr_wV_xX_y)_z$$

wherein RE is samarium, cerium, cerium mischmetal (MM), praseodymium, neodymium, lanthanum or mixtures thereof, X is Cu, Al or mixtures thereof, and $0.05<u<0.15$
$0.02<v<0.15$
$0.02<w<0.10$
$0.02<x<0.10$
$0.05<y<0.20$
$6.5<z<8.5$ which has been prepared by the process which comprises casting the alloy of the molten starting materials in a physical shape as similar as possible to that desired for the end product; solidifying the cast alloy by directed crystallization; homogenizing it at a temperature just below the solidus temperature; and then annealing heat-treating it in the region from 700° C. to 900° C.

5. The monophase alloy of any of claims 1, 2, 3, or 4 wherein $7.0<z<7.5$.

* * * * *

UNITED STATES PATENT AND TRADEMARK OFFICE

CERTIFICATE OF CORRECTION

PATENT NO. : 4,192,696

DATED : March 11, 1980

INVENTOR(S) : ANTON MENTH ET AL

It is certified that error appears in the above-identified patent and that said Letters Patent are hereby corrected as shown below:

Please correct the Related U.S. Application Data to read as follows:

[63] --Continuation-in-part of Ser. No. 746,226, Nov. 30, 1976, Pat. No. 4,131,495.-- rather than

[63] --Continuation-in-part of Ser. No. 746,226, Nov. 3, 1976, Pat. No. 4,131,495.

Signed and Sealed this

*Fifth* Day of *August 1980*

[SEAL]

*Attest:*

SIDNEY A. DIAMOND

*Attesting Officer*

*Commissioner of Patents and Trademarks*